US005826818A

United States Patent [19]

Douaud

[11] Patent Number: 5,826,818

[45] Date of Patent: Oct. 27, 1998

[54] COMPACT STRIP PROCESSING FACILITY

[75] Inventor: Alain Douaud, Pittsburgh, Pa.

[73] Assignee: Kvaerner U.S. Inc., Pittsburgh, Pa.

[21] Appl. No.: 886,104

[22] Filed: Jun. 30, 1997

[51] Int. Cl.[6] ..... B65H 23/32; B21B 41/02

[52] U.S. Cl. ..... 242/615.21; 72/231

[58] Field of Search ..... 242/615.21; 226/102; 72/231

[56] References Cited

U.S. PATENT DOCUMENTS

| | | | |
|---|---|---|---|
| 3,721,114 | 3/1973 | Yazawa et al. | 242/615.21 X |
| 3,737,091 | 6/1973 | Barta et al. | 242/615.21 X |
| 4,083,218 | 4/1978 | Berz . | |
| 4,358,887 | 11/1982 | Creps . | |
| 4,385,716 | 5/1983 | De Roeck et al. | 242/615.21 X |
| 4,872,245 | 10/1989 | Kawasaki et al. . | |
| 5,003,804 | 4/1991 | Kenmochi et al. . | |
| 5,092,573 | 3/1992 | Abreu | 242/615.21 X |
| 5,197,179 | 3/1993 | Sendzimir et al. . | |
| 5,413,039 | 5/1995 | Sohma | 242/615.21 X |
| 5,480,499 | 1/1996 | Wangerin et al. | 242/615.21 X |

FOREIGN PATENT DOCUMENTS 2336331 10/1979 France .

*Primary Examiner*—Michael Mansen
*Attorney, Agent, or Firm*—Armstrong, Westerman Hattori, McLeland & Naughton

[57] ABSTRACT

A compact facility for treating flexible strip material, particularly cold rolled metal strip, has a strip entry section, a strip treating section and a strip exit section, in which at least one of the strip entry section and the strip exit section is disposed in spaced-apart, side-by-side and parallel relationship with the treating section, resulting in facility installation space savings and elimination of all but one operator's pulpit. The moving strip is turned by two or more turning devices from the direction of travel in the entry section to a direction along the length of the treating section and from the treating section to a direction along the length of the exit section.

17 Claims, 4 Drawing Sheets

COMPACT STRIP PROCESSING FACILITY

BACKGROUND

1. Field of the Invention

This invention relates to compact strip processing facilities and, more particularly, to a facility in which operative steps carried out in the facility are disposed in parallel arrangement, thereby shortening the required distance for installation of the facility as compared to the usual in line steps, and eliminating the need for multiple operator pulpits in favor of a single pulpit for control of the several steps carried out in the facility. The invention is especially useful in the treatment of metal strip downstream from a cold rolling operation.

2. Description of the Prior Art

Cold rolling of metal strip often is followed by various processing steps such as pickling, galvanizing or other coating, etc. A continuous processing line basically consists of one or more strip entry or pay-off reels, an entry accumulator, a strip process or treating section, an exit accumulator and a strip exit take-up reel or downcoiler. Incoming coils of strip are located at the entry section of the facility and processed coils are removed at the exit section. The entry and exit accumulators allow a constant speed to be maintained in the process section. Most such prior art facilities are designed to have the strip go straight through the line, or, if the process layout permits, e.g. if the process section can be disposed in an elevated position, having the strip double back so that the exit section and the entry section are adjacent each other and, e.g. disposed below the process section. However, in many cases, such double-back arrangements are not possible due to the location requirements for the process section of the facility, and a straight-through arrangement is necessitated. This necessitates installing separate operator pulpits for the entry, process and exit sections, at added cost of installation, maintenance and operation.

SUMMARY OF THE INVENTION

The compact processing facility of the invention comprises an entry section, which may include a pay-off reel or uncoiler and an entry strip accumulator; a process section, and an exit section which may include an exit strip accumulator and a take-up reel or downcoiler. At least the entry section, and preferably, both the entry and exit sections, are spaced from the process section and parallel thereto in side-by-side ground level relationship so that substantial space savings are realized. Between the entry section and the process section there are disposed two turning devices, each turning the strip 90° in the direction of the process section so that the strip can be directed into the latter section. Preferably, two such turning devices also are disposed between the process section and the exit section, each also turning the strip 90° for its entry into the exit section of the facility. Not only does such a facility provide space savings, but also it reduces the number of operator pulpits, with their accompanying installation, maintenance and operating costs, by reducing the required number of pulpits to a single one for controlling all operations carried out in the compact facility.

DESCRIPTION OF PREFERRED EMBODIMENTS

Figure 1:
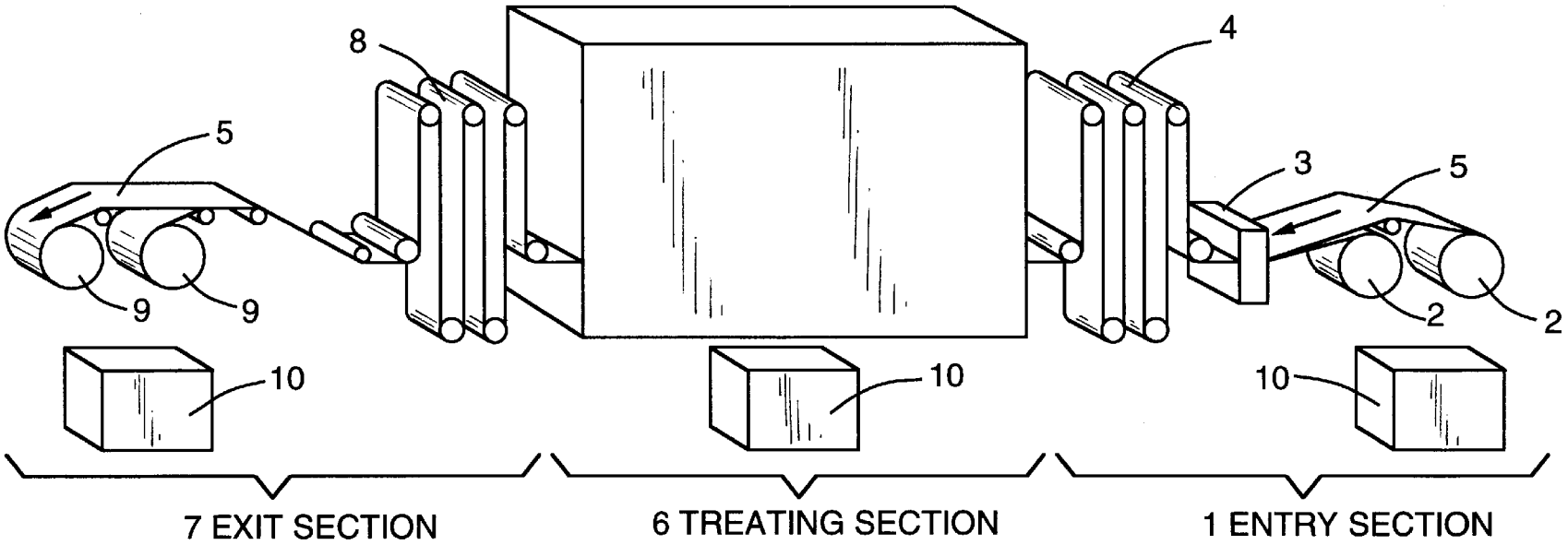
FIG. 1 PRIOR ART
FIG. 1 is a side elevational view of a "straight-through" type process facility of the prior art.

FIG. 1 illustrates a "straight-through" in-line facility, the most common type of prior art facility for treating cold rolled metal strip 5 and comprising an entry section denoted generally by the numeral 1 and comprising one or more strip pay-off reels 2, joining machine 3 for joining adjacent ends of strip, a strip entry accumulator 4, a process or treating section 6, and a strip exit section denoted generally by the numeral 7 and comprising a strip exit accumulator 8 and one or more strip exit take-up reels or downcoilers 9. As above-noted, this arrangement requires three separate operator pulpits 10 for the entry, process and exit sections which adds to the installation, operation and maintenance costs of such facility.

In the following drawings, the same numerals are used to denote similar facility elements.

Figure 2:
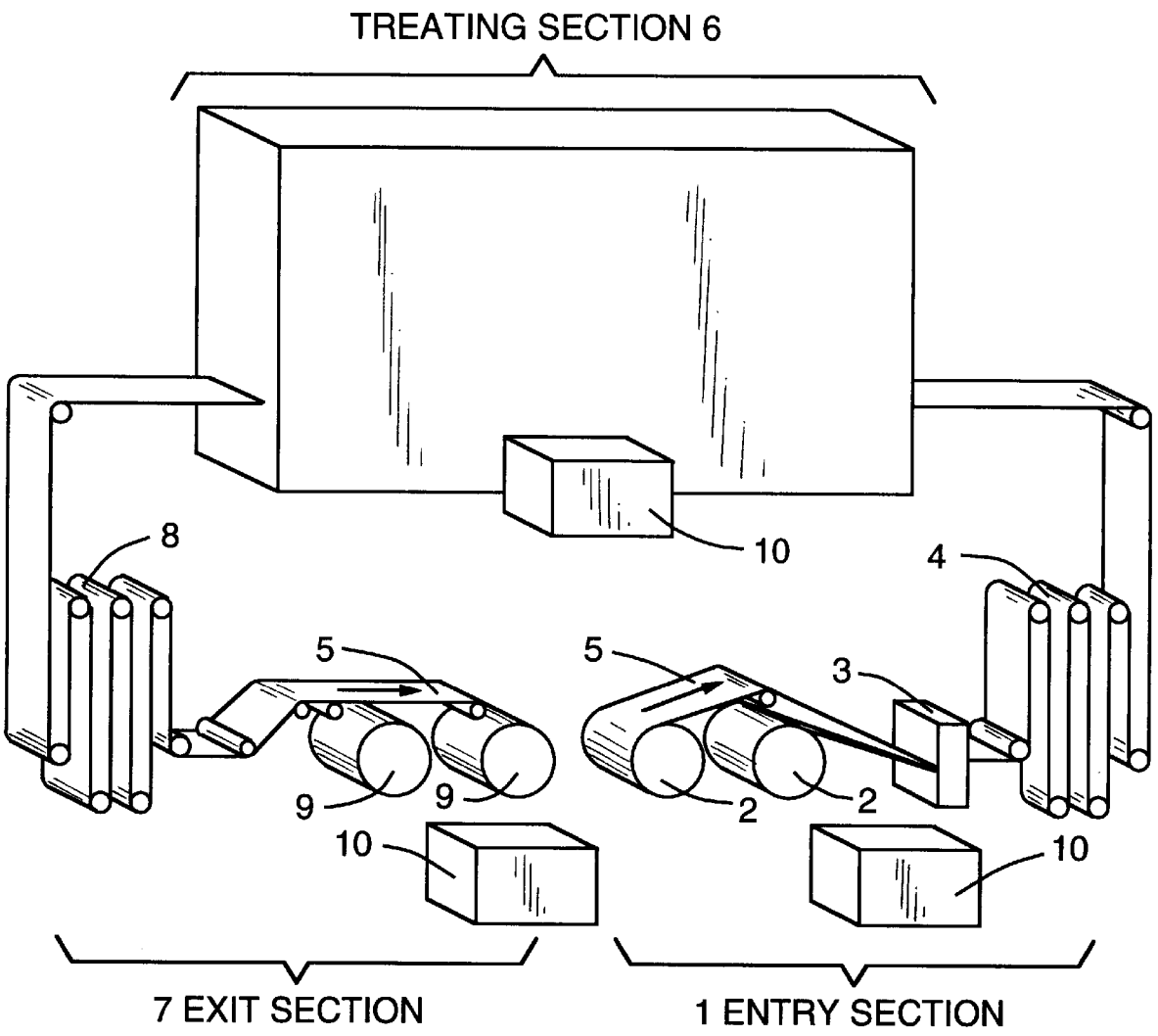
FIG. 2 PRIOR ART
FIG. 2 is a side elevational view of a "double-back" type process facility of the prior art.

FIG. 2 illustrates another, "double-back", form of such prior art facilities in which the strip entry and exit sections are vertically spaced apart with the treating section disposed above the double-backed in-line entry and exit sections. As in the FIG. 1 facility arrangement, this arrangement also necessitates three separate operator pulpits.

Figure 3:
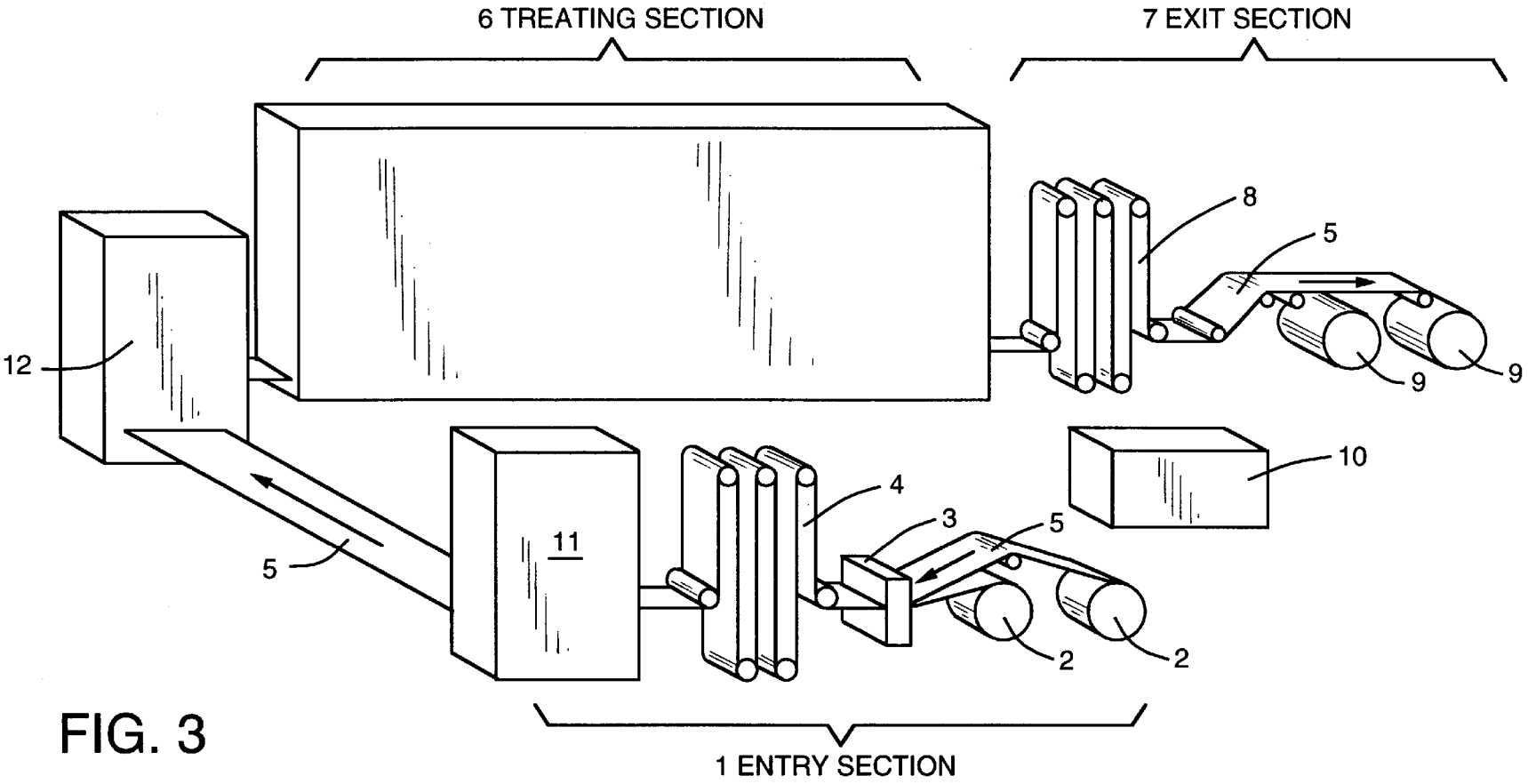
FIG. 3 is an isometric view, in side elevation, of one form of a compact facility of the invention in which the entry section of the facility is spaced from and parallel to the process section.

FIG. 3 illustrates one embodiment of this invention wherein the entry section is disposed on ground level beside and spaced from the treating section and substantially parallel thereto. A first strip turning device 11 is disposed downstream of the entry accumulator 4 and in front of the treating section 6 so that moving strip 5 passes into the first turning device 11 from the entry accumulator 4, is turned 90° and then enters a second strip turning device 12 in which the moving strip 5 is turned a further 90° for entry into the treating section 6 of the facility. Similar to such portion of a facility as shown in FIG. 1, the facility of FIG. 3 comprises an in-line exit accumulator 8 and at least one exit or take-up reel 9. However, in the case of the FIG. 3 facility, the close arrangement of the entry and exit sections permit the provision of a single operator pulpit. Such arrangement permits significant space savings in installation of the facility.

Figure 4:
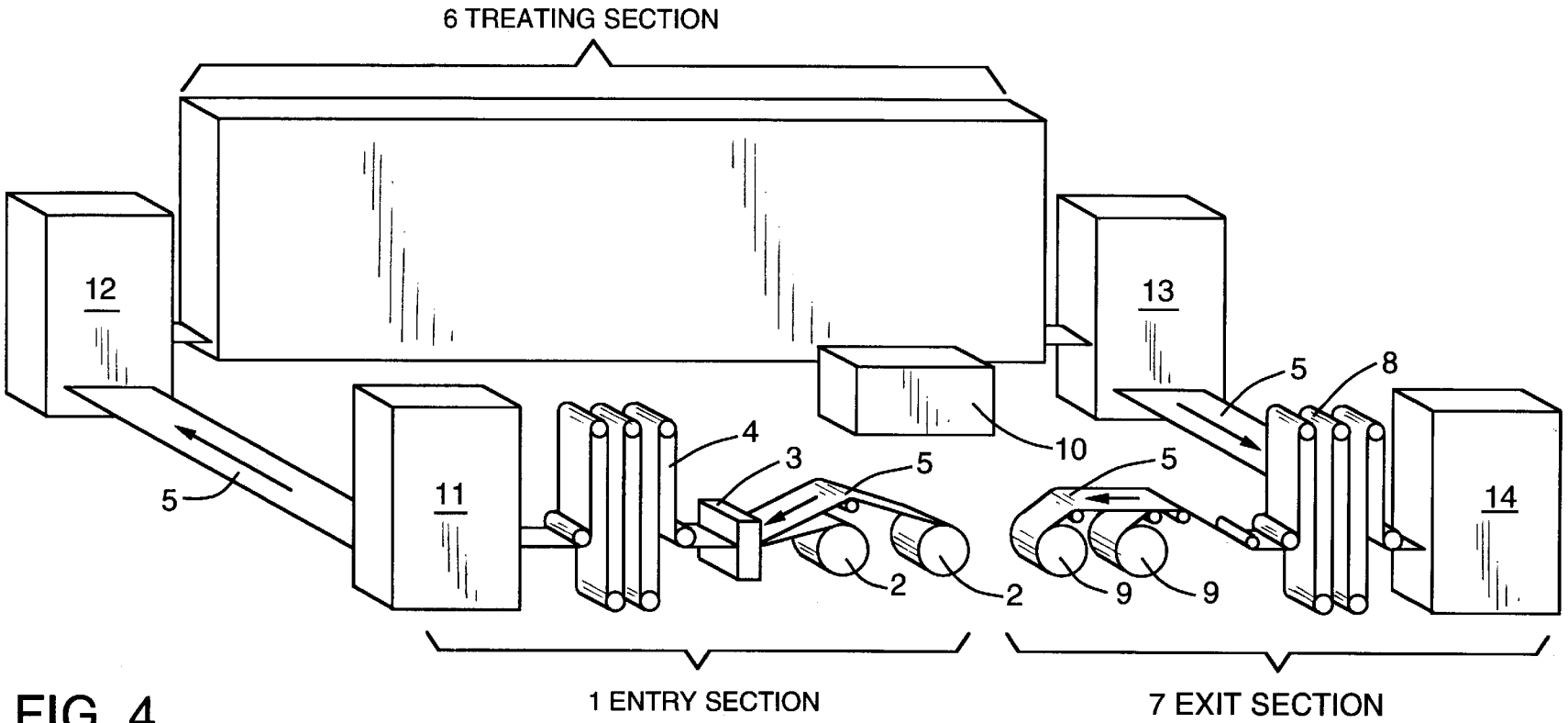
FIG. 4 is an isometric view, in side elevation, of another form of a compact facility of the invention in which both the entry and exit sections of the facility are spaced from and parallel to the process section.

A preferred embodiment of the invention is illustrated in FIG. 4 in which both the entry section 1 and the exit section 7, and the components thereof, are disposed in spaced apart position parallel to the treating section 6 and on ground level the same as the treating section. In this embodiment there is provided a third strip turning device 13 spaced downstream of the treating section 6 and which receives treated strip 5 and turns it approximately 90° from the longitudinal axis of the treating section and toward the exit section 7. A fourth turning device 14 receives the moving strip 5 from the third strip turning device 13 and turns it approximately 90° for entry into the exit section 7 and as specifically shown in FIG. 4, into the strip exit accumulator 8.

It is to be understood that other dispositions may be made of the several strip turning devices. Dispositions of the strip turning devices include: between the entry accumulator and the treating section (FIGS. 3 and 4) and between the treating section and the exit accumulator (FIG. 4). Other dispositions may be made, for example, between the pay-off reel(s) of the entry section and the entry accumulator, or between the exit take-up reel(s) and the exit accumulator. Such other arrangements provide a facility otherwise similar to those shown in FIG. 3 and 4.

In the preferred arrangement of FIG. 4, and other arrangements in which both the entry and exit sections are by the side of the treating section, it is possible to eliminate the need for separate operator pulpits or operating stations for the entry section, the treating section and the exit section and substitute a single pulpit 10 for controlling operation of each section of the facility. In addition to the space savings so realized, the savings in installation, maintenance and operation of a single pulpit is significant.

What is claimed is:

1. A compact facility is of reduced installation, operation and maintenance cost for treating an elongated flexible cold rolled metal strip including a strip entry section, a strip treating section, and a strip exit section, the improvement which comprises a strip entry section which is disposed in a line spaced side-by-side from and parallel to the strip treating section, a first strip turning device disposed at the exit of the strip entry section for receiving and turning the strip approximately 90° from the line of the strip entry section in a direction toward the strip treating section, and a second turning device disposed in front of the strip treating section for receiving and turning the strip from the first strip turning device approximately 90° for entry of the strip into the strip treating section.

2. A facility according to claim 1, wherein the strip entry section comprises at least one strip entry pay-off reel and a strip entry accumulator, and the strip exit section comprises a strip exit accumulator and at least one strip exit take-up reel.

3. A facility according to claim 2, wherein the first strip turning device is disposed between the entry accumulator and the second strip turning device.

4. A facility according to claim 2, wherein the second strip turning device is disposed between the first strip turning device and the strip treating section.

5. A compact facility of reduced installation, operating and maintenance cost for treating an elongated flexible cold rolled metal strip including a strip entry section, a strip treating section, and a strip exit section, the improvement which comprises a strip entry section which is disposed in a line spaced side-by-side from and parallel to the strip treating section, a first strip turning device disposed at the exit of the strip entry section for receiving and turning the strip approximately 90° from the line of the strip entry section in a direction toward the strip treating section, a second turning device disposed in front of the strip treating section for receiving and turning the strip from the first strip turning device approximately 90° for entry of the strip into the strip treating section, wherein the strip exit section is disposed in-line with the strip entry section parallel to and spaced from the strip treating section and further comprising a third strip turning device disposed adjacent an exit of the strip treating section for receiving and turning the strip approximately 90° from a longitudinal line of the strip treating section and in a direction toward the strip exit section, and a fourth strip turning device disposed in the path of travel of the strip exiting the third strip turning device for receiving and turning the strip approximately 90° and in a direction in line with the strip entry section and directing the strip into the strip exit section whereby the length of required facility installation space is reduced and the resulting adjacent spacing of the entry, treating and exit sections reduces the required number of operator pulpits to a single one for controlling all operations of the compact facility.

6. A facility according to claim 5, wherein the strip entry section comprises a strip entry pay-off reel and a strip entry accumulator, and the strip exit section comprises a strip exit accumulator and a strip exit take-up reel.

7. A facility according to claim 6, wherein the third strip turning device is disposed between the strip treating section and the fourth strip turning device.

8. A facility according to claim 7, wherein the fourth strip turning device is disposed between the third strip turning device and the strip exit takeup reel.

9. A facility according to claim 6, wherein the fourth strip turning device is disposed between the third strip turning device and the strip exit accumulator.

10. A facility for treating an elongated flexible strip including a strip entry section, a strip treating section, and a strip exit section, the improvement which comprises a strip entry section disposed in a line spaced from and parallel to the strip treating section, and means to turn the moving strip exiting the strip entry section approximately 180° for entry of the strip into the strip treating section.

11. A facility according to claim 10, further comprising a strip exit section spaced from and substantially parallel to the strip treating section and spaced from and in-line with the strip entry section, and means to turn the moving strip exiting the strip treating section approximately 180° for entry into the strip exit section.

12. A method of compacting and reducing the cost of installing, operating and maintaining a facility for the treating of an elongated flexible cold rolled metal strip moving through the facility which includes a strip entry section, a strip treating section, and a strip exit section, comprising spacing at least one of the strip entry and strip exit sections side-by-side from the strip treatment section and substantially parallel thereto, and turning the moving strip approximately 180° from a longitudinal direction of the strip entry section for receipt by and entry into the strip treating section, and thereby reducing the length of required facility installation space and the number of operator pulpits to a single one for controlling all operations of the compact facility.

13. A method according to claim 12 wherein both the strip entry and strip exit sections are spaced side-by-side from and substantially parallel to the strip treating section, and turning the moving strip approximately 180° from a longitudinal direction of the strip treating section for receipt by and entry into the strip exit section.

14. A method according to claim 13, wherein the strip entry section comprises a strip entry pay-off reel and a strip entry accumulator, and the strip exit section comprises a strip exit accumulator and a strip exit take-up reel in line with and spaced from the strip entry pay-off reel.

15. A method according to claim 13, comprising disposing at least one strip turning device between the strip entry accumulator and the strip treating section.

16. A method according to claim 13, comprising disposing at least one strip turning device between the strip treating section and the strip exit accumulator.

17. A method according to claim 13, comprising disposing at least one strip turning device between the strip exit accumulator and the strip exit take-up reel.

* * * * *